United States Patent [19]

Yamada et al.

[11] 3,930,480

[45] Jan. 6, 1976

[54] FUEL-INJECTION PUMP FOR AN INTERNAL COMBUSTION ENGINE

[75] Inventors: Tadashi Yamada, Suita; Toshio Banba, Takatsuki, both of Japan

[73] Assignee: Yanmar Diesel Engine Co., Ltd., Osaka, Japan

[22] Filed: May 2, 1974

[21] Appl. No.: 466,341

[52] U.S. Cl. .... 123/139 BD; 417/499; 123/139 AD

[51] Int. Cl.[2] ..... F02M 39/00

[58] Field of Search. 123/139 BD, 139 AB, 139 AS, 123/139 AD, 139 R, 139 ST, 139 AA, 139 AY; 417/289, 499

[56] References Cited

UNITED STATES PATENTS

| | | | |
|---|---|---|---|
| 2,544,561 | 3/1951 | Meyer | 123/139 BD |
| 2,778,351 | 1/1957 | Links | 123/139 BD |
| 2,868,131 | 1/1959 | Parker | 417/499 |
| 2,890,657 | 6/1959 | May | 417/499 |
| 3,020,902 | 2/1962 | Sjoblom | 123/139 BD |
| 3,046,963 | 7/1962 | Bessiere | 123/139 BD |
| 3,123,006 | 3/1964 | Partridge | 417/499 |
| 3,127,841 | 4/1964 | Friedlander | 417/499 |
| 3,620,640 | 11/1971 | Hofer | 123/139 BD |
| 3,673,996 | 7/1972 | Dreisin | 123/139 BD |
| 3,777,731 | 12/1973 | Kobayashi | 123/139 BD |

*Primary Examiner*—Wendell E. Burns
*Assistant Examiner*—Daniel J. O'Connor
*Attorney, Agent, or Firm*—Ladas, Parry, Von Gehr, Goldsmith & Deschamps

[57] ABSTRACT

A fuel injection pump for an internal combustion engine wherein a plunger is mounted in a barrel for sliding axial movement and rotation about its own axis, and the barrel is formed therein with a suction port and an outlet port. A metering groove is formed in the plunger and maintained in communication with a top of the plunger through a bore formed in the plunger, so that a desired amount of metered fuel can be delivered to the engine according to the load applied to the engine by varying the area and the time at which the metering groove is brought into communication with the outlet port, thereby varying the amount of fuel outflow. A pulsation control chamber of a greater sectional area is formed in the fuel passageway between a discharge valve of the pump and a fuel valve so as to intensify and prolong the duration of throbs of a pulsating current of fuel moved through the pulsation control chamber as it is delivered by pumping.

6 Claims, 13 Drawing Figures

FUEL-INJECTION PUMP FOR AN INTERNAL COMBUSTION ENGINE

This invention relates to a fuel-injection pump for an internal combustion engine.

There are two principal types of fuel-injection pumps for internal combustion engines now being in use. They are of the Bosch type and Deckel type. In the former, a cutout is formed in the plunger so as to vary the termination of compression of fuel according to the load applied to the engine. The latter is of a construction such that a metering valve for adjusting the fuel outflow by means of the engine governor is mounted in the fuel delivery passageway while the plunger delivers a constant amount of fuel at all times, whereby the desired amount of fuel can be metered and delivered.

Some disadvantages are associated with these two fuel injection systems. In the Bosch type, a fuel supply port in the barrel is opened and closed by the cutout formed in the plunger, so that compression of the fuel is initiated and terminated suddenly. In the Deckel type, the metering valve for varying the degree of throttling is complex in construction, and difficulty is experienced as the engine speed is increased to throttle and meter a proper amount of fuel fit for the load applied to the engine.

This invention obviates the aforementioned disadvantages of the prior art while retaining the features of fuel-injection pumps of the Bosch and Deckel types.

Accordingly, an object of the invention is to provide a fuel-injection pump for an internal combustion engine which permits control of the fuel delivery to be effected by varying the outflow of fuel when fuel is compressed depending on the engine speed and the load applied to the engine.

Another object of the invention is to increase the fuel atomizing force by providing a pulsation control chamber of a larger sectional area in the fuel passageway from the discharge valve to the fuel valve so as to increase the pressure under which fuel is delivered when the engine is at low speeds.

Another object of the invention is to improve the performance of the engine by varying the rate of fuel injection (the change in the amount of fuel delivered per unit time during the injection period) according to the load applied to the engine.

Another object of the invention is to vary the time of injection of fuel by varying the termination and/or initiation of compression of fuel depending on the engine speed.

The outstanding characteristics of the invention will be summarized. A metering groove is formed at one side of the plunger of the fuel-injection pump for an internal combustion engine mounted in the barrel for axial sliding movement and rotation about its own axis so as to deliver fuel to the engine when the plunger moves in sliding movement. The metering groove is maintained in communication with a top of the plunger through an axial center bore formed in the plunger. The barrel is formed therein with an outlet port and a suction port. A desired amount of metered fuel can be delivered to the engine by varying the area and the time at which the metering groove or port is brought into communication with the outlet port, thereby varying the amount of fuel outflow. A pulsation control chamber of a greater sectional area is formed in the fuel passageway between the discharge valve of the pump and the fuel valve so as to intensify and prolong the duration of throbs of a pulsating current of fuel moved through the pulsation control chamber as it is delivered by pumping.

Other and additional objects and features of the invention will become evident from the description set forth hereinafter when considered in conjunction with the accompanying drawings, in which.

Figure 1:
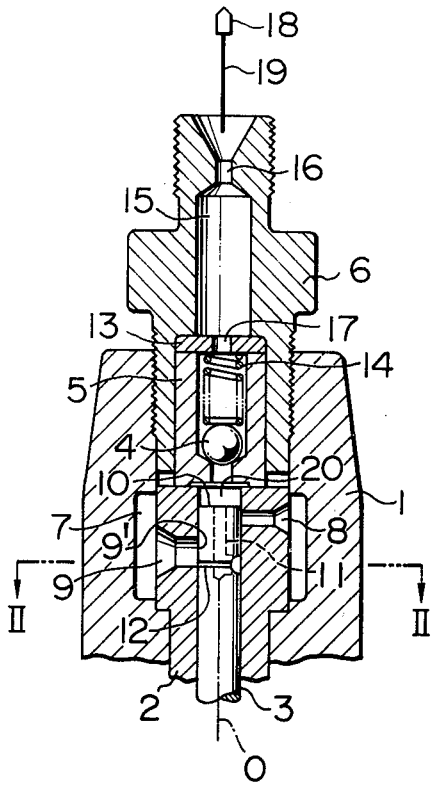
FIG. 1 is a vertical sectional view of the fuel-injection pump for an internal combustion engine comprising one embodiment of the invention.
Figure 2:
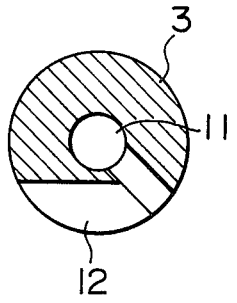
FIG. 2 is a sectional view on the line II—II of FIG. 1.

A first embodiment of the invention shown in FIG. 1 to FIG. 9 will first be described. A barrel 2 mounting a plunger 3 therein for axial sliding movement and rotation about its own axis is disposed in a pump body 1. Disposed above the barrel 2 and connected to the pump body 1 through a pipe joint 6 is a discharge valve guide 5 having a discharge valve 4 mounted therein.

The barrel 2 is formed therein with a suction port 8 and a circular outlet port 9 maintained in communication with a fuel reservoir 7. An orifice 9' of the outlet port 9 is elliptic in form as seen in plan view as shown in FIG. 3. The plunger 3 is formed therein with a bore 11 which extends therethrough from a top 10 of the plunger 3 and opens at its outer peripheral surface and through which communication can be maintained between the top 10 and a metering groove 12 formed in the plunger 3 and disposed at right angles to the center axis 0 of the plunger 3. A spring 14 is mounted between a spring seat 13 and the discharge valve 4 so as to bias the latter.

A pulsation control chamber 15 is formed between fuel passages 16 and 17 and has a sectional area which is greater than that of the passages 16, 17 and a high pressure line 19 connected to a fuel valve 18. 20 designates a fuel compression chamber. The plunger 3 can be moved in reciprocatory sliding movement by a cam mechanism or other suitable known means and also rotated by a rack and pinion arrangement or other suitable known means.

Figure 3A:
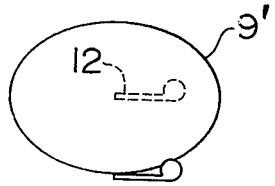
FIG. 3A to FIG. 3C are plan views in explanation of the operation of the pump.
Figure 3B:
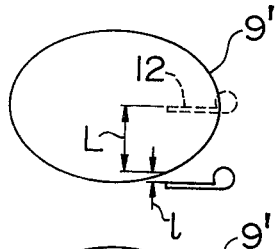
Figure 3C:
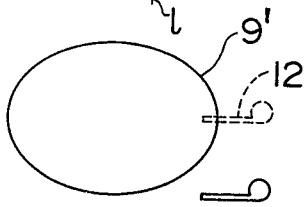

FIG. 3A shows the plunger 3 in a zero ejection position in which the metering groove 12 is maintained in communication with the orifice 9' at all times during the whole stroke of the plunger 3, so that no fuel is compressed. If the plunger 3 is rotated to a position shown in FIG. 3B in which the engine is at intermediate loads, fuel will be compressed and discharged during a portion *l* of the plunger stroke before the metering groove 12 is brought into communication with the orifice 9′ and will not be compressed during the rest of the portion L of the plunger stroke. During the rest of the portion L of the stroke, the area of the metering groove 12 in communication with the orifice 9′ gradually increases as the upward movement of the plunger 3 brings the metering groove 12 and the orifice 9′ into overlapping relation. Thus, liberation of fuel pressure is gradually effected. If the plunger is rotated to a position shown in FIG. 3C at heavy loads, the area of the metering groove 12 brought into communication with the orifice 9′ will be reduced, so that fuel will be compressed and discharged during the major portion of the stroke of the plunger 3. By rotating the plunger 3 in this way according to the load applied to the engine, it is possible to vary the rate of the outflow of fuel and the desired amount of fuel is metered, so that a proper amount of fuel can be injected through an injection valve.

Figure 4:
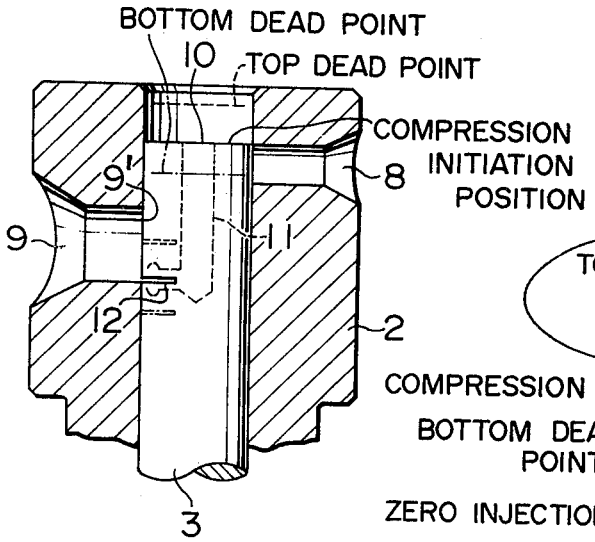
FIG. 4 is a vertical sectional view, on an enlarged scale; of essential portions of the pump shown in FIG. 1.
Figure 5:
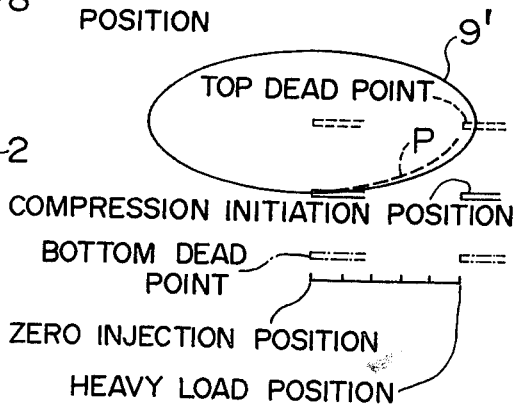
FIG. 5 is a plan view, on an enlarged scale, in explanation of the operation of the pump.

FIG. 4 and FIG. 5 show that the metering groove 12 is in communication with the outlet port 9 at least when compression of fuel is initiated, with the plunger 3 in its zero injection position. By this arrangement, it is possible to eliminate a lag of the fuel outflow in a pump of the type in which the fuel outflow is throttled, even if the rate of movement of the plunger becomes high, thereby permitting a zero injection operation to be performed. That is, the metering groove 12 is brought into communication with the outlet port 9 to prevent compression of fuel at the beginning of fuel compression when the suction port 8 is closed by the upper end of the plunger 3 disposed at the zero injection position. This provides improvements in pumps of this type so that the discharge of a small amount of fuel due to a lag of the fuel outflow can be prevented even when the plunger moves in sliding movement at high rates. If the plunger 3 is rotated into a heavy load position, fuel will be compressed till the metering groove 12 is brought into communication with the outlet port 9. It should be understood that, as the plunger speed becomes higher, a lag of the fuel outflow occurs, and the position in which fuel begins to flow out shifts higher from the edge of the outlet port 9 to a position P as shown in FIG. 5, so that the fuel outflow actually starts at the position P.

Another feature of the invention which is the provision of the pulsation control chamber 15 will now be described with reference to FIG. 6 and FIG. 7. At the time the engine is started, the plunger speed is very low. At such time, the charge of fuel delivered through the discharge valve to the fuel passageway of the prior art which has no pulsation control chamber formed therein so that the fuel passageway has a constant sectional area is under a pressure such that throbs of the pulsating stream of fuel are weak and short in duration as shown in broken lines in FIG. 6. Since the pulsation of the fuel delivery to the fuel valve is as aforementioned, the fuel atomizing force (the force with which fuel is atomized when passed through the fuel valve) is low, and the engine thus has a poor starting characteristic.

Figure 6:
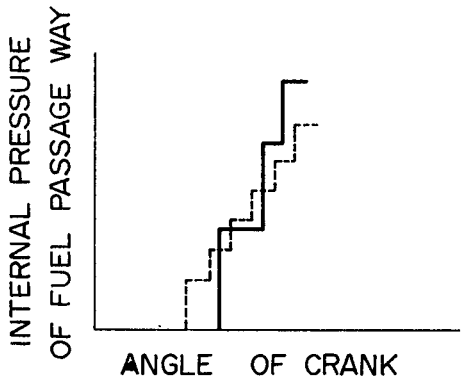
FIG. 6 is a graph showing pulsation of the fuel charge flowing through the fuel passageway by the pumping action.

This disadvantage can be eliminated and the starting characteristic of the engine can be improved by providing the pulsation control chamber 15 which enables throbs of the pulsating stream of fuel to be intensified and prolonged in duration as shown in solid lines in FIG. 6. Thus, the fuel deliverty to the fuel valve is under a higher pressure than in the prior art, thereby increasing the force with which fuel is atomized when passed through the fuel valve.

Figures 7A, 7B:
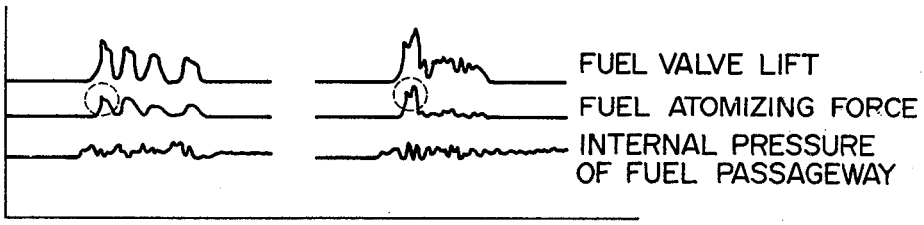
FIG. 7 is a graph showing the fuel atomizing forces; FIG. *7a* showing data for the prior art, FIG. *7b* showing data for the present invention, and FIG. *7c* showing a comparison of the fuel atomizing force of the pump of this invention with that of the prior art.
Figure 7C:
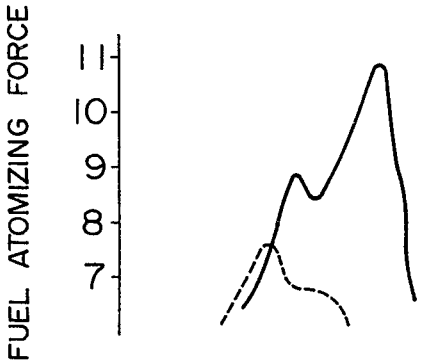

FIG. 7*a* is a graph showing the fuel valve lift, the fuel atomizing force and the internal pressure of the fuel passageway of the prior art, while FIG. 7*b* is a graph showing the corresponding data obtained with the pump according to the invention. FIG. 7*c* shows a comparison of the fuel atomizing force of the pump according to the invention with that of the prior art. By increasing the fuel atomizing force in this way, the fuel injected into the engine by the pump according to the invention mixes well with the suctioned air, thereby facilitating starting of the engine. The provision of the pulsation control chamber 15 is also effective to damp the pressure waves which might otherwise be returned from the fuel valve to the pump side, so that secondary injection which might otherwise be caused by the action of such pressure waves on the fuel valve can be prevented.

Figure 8:
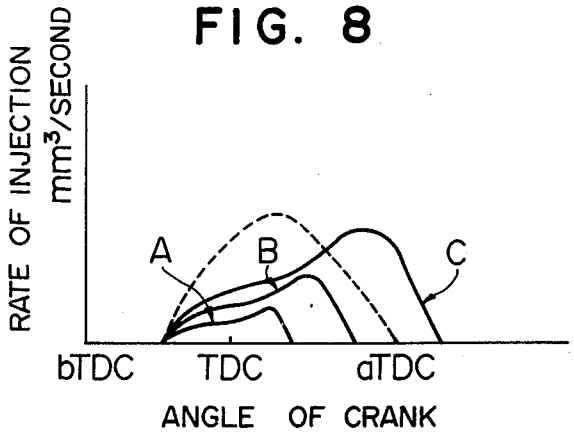
FIG. 8 is a graph showing the rates of fuel injection.

FIG. 8 shows that changes can be caused to occur in the rate of fuel injection when the pump according to the invention is employed. In a conventional pump of the Bosch type, the rate of injection is, as shown in a broken line, constant at all times regardless of the load applied to the engine, because the fuel delivered during the compression period is not metered by outflow. The pump whose fuel injection rate is such as aforementioned does not possess the capability of reducing the maximum pressure in the cylinders of the engine for which there has in recent years been an increasing demand. Combustion starts instantaneously in such engine, with a result that the service life of the engine will be shortened.

On the other hand, by providing means for effecting metering of fuel by outflow while fuel is delivered to the engine, the fuel injection rate can be varied according to the invention as shown in solid lines in the figure, with the lines (A), (B) and (C) representing fuel injection rates at light, intermediate and heavy loads respectively. It will be seen that the rate of fuel injection is lower in the initial stages of injection and higher in the terminal stages thereof at all loads. The fuel injection rate of the pump of this type can be varied as desired by changing the position in which the metering groove 12 is brought into communication with the outlet port 9. It is possible to provide any engine with a pump of the type which best fits it merely by varying the relative positions of the barrel 2 and plunger 3. The invention is thus conductive to a reduction of the highest pressure in the engine, prolonged service life of the engine, and increased degree of efficiency with which combustion can be accomplished.

Figure 9:
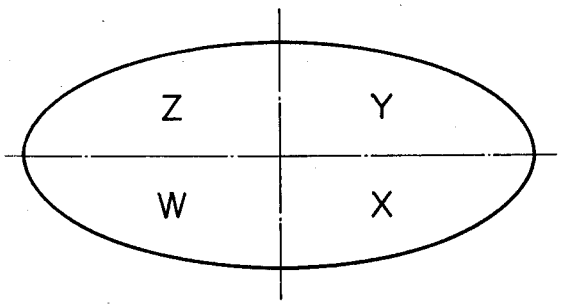
FIG. 9 is a view showing the outlet port divided into a plurality of sections.

FIG. 9 shows that the relative positions of the plunger 3 and the barrel 2 can be varied. As shown, the outlet port 9 is divided into a plurality of sections W, X, Y and Z, and any section may be used as desired for effecting metering. In this embodiment, the W and X sections are used for effecting metering by outflow of fuel at the end of compression and Y and Z sections are used for the same purpose at the beginning of compression. These sections may be used one at a time or more than one of them at the same time. By this arrangement, it is possible to reduce the stroke of the plunger and increase its speed, and at the same time to render the time of initiation of the fuel delivery or termination thereof fit for the use to which the engine is put.

The present invention enables fuel to be delivered while letting part of the fuel to flow out. This feature is effective to prevent a sudden rise in the pressure of fuel in the fuel passageway which occurs when a pump of the Bosch type is employed, so that the need to suck back fuel from the fuel passageway can be eliminated. This is conductive to reduced cost, because a valve of the simple construction, such as a check valve, can be employed in place of a valve of the complex construction, such as a suck-back valve provided with a collar.

We claim:

1. A fuel-injection pump for an internal combustion engine, said pump comprising a barrel member defining a cylindrical bore and formed with a suction port and an outlet port at the periphery of said port, a plunger fitted in the cylindrical bore to reciprocate axially therein and having one end disposed within the bore and bounding a fuel compression chamber which is also bounded by the periphery of the bore, and a discharge valve controlling egress of fuel from said fuel compression chamber, the plunger being formed with a narrow metering slit disposed substantially at right angles to the central axis of the plunger and with a passageway which maintains communication between said slit and said fuel compression chamber, the plunger being rotatable within said bore about said central axis to bring said metering slit and said outlet port into overlapping relationship and to vary the proportion of, and the position within, the reciprocating movement range of the plunger in the bore for which the metering slit and the outlet port remain in overlapping relationship.

2. A fuel-injection pump as claimed in claim 1, further comprising a fuel-injection valve and duct means defining a passage connecting the outlet valve to said fuel-injection valve, said passage including a pulsation control chamber of larger cross-sectional area than the rest of said passage.

3. A fuel-injection pump as claimed in claim 1, wherein the plunger has a rotational position in which said metering slit and the outlet port are in overlapping relationship at the start of axial movement of the plunger in the direction to compress fuel in the fuel compression chamber.

4. A fuel-injection pump as claimed in claim 1, wherein said outlet port is divided into a plurality of sections by a plane through the central axis of the plunger and a plane perpendicular to said central axis, the plunger being arranged in such manner that at least one of said plurality of sections is employed for effecting metering of fuel delivery by fuel outflow through said section or sections.

5. A fuel-injection pump for an internal combustion engine, said pump comprising a barrel member formed with a suction port and an outlet port at the periphery of said bore and communicating with a fuel reservoir, a plunger fitted in the cylindrical bore with one end disposed within the bore and bounding a fuel compression chamber which is also bounded by the periphery of the bore, and a discharge valve for controlling egress of fuel from said fuel compression chamber, the plunger being reciprocable axially in the cylindrical bore between a first end position in which the suction port is closed off by the plunger and a second end position in which the suction port communicates with the fuel compression chamber, at least part of the periphery of the outlet port being oblique to the common central axis of the plunger and the bore, and the plunger being formed with a narrow metering slit disposed substantially at right angles to said central axis and with a passageway which maintains communication between said slit and said fuel compression chamber, the plunger being rotatable within said bore about said central axis so that at a given axial position of the plunger in its range of reciprocating movement with respect to the bore, the metering slit partially overlaps the outlet port at said oblique part of the periphery thereof.

6. A fuel injection pump as claimed in claim 5, wherein the periphery of the outlet port is elliptical.

* * * * *